US005848723A

United States Patent [19]

Krautsack

[11] Patent Number: 5,848,723

[45] Date of Patent: Dec. 15, 1998

[54] FOLDABLE COUPON DISPENSER

[76] Inventor: Richard G. Krautsack, Stillwater Cove, Unit 14 120 Rte. 28, Crystal Bay, Nev. 89402

[21] Appl. No.: 717,664

[22] Filed: Sep. 26, 1996

[51] Int. Cl.[6] ..... B65H 1/00; A45C 11/18

[52] U.S. Cl. ..... 221/35; 221/33; 221/45; 221/282; 206/831; 206/39.5

[58] Field of Search ..... 221/33, 35, 45, 221/282; 312/42, 50; 206/39.5, 449, 555, 831, 39, 39.8; 220/339

[56] References Cited

U.S. PATENT DOCUMENTS

| | | | |
|---|---|---|---|
| D. 299,094 | 12/1988 | Mills . | |
| D. 302,704 | 8/1989 | Krautsack . | |
| D. 328,543 | 8/1992 | Kringel et al. . | |
| D. 347,344 | 5/1994 | Schumaker . | |
| D. 347,575 | 6/1994 | Davis . | |
| 546,849 | 9/1895 | Hughes . | |
| 1,099,214 | 6/1914 | Sterling | 206/39.3 |
| 1,715,016 | 5/1929 | Taylor et al. | 206/449 |
| 4,155,484 | 5/1979 | Pastore | 221/35 |
| 4,511,034 | 4/1985 | Pan | 206/555 |
| 4,953,746 | 9/1990 | Andriash | 221/35 |
| 5,131,561 | 7/1992 | Casperson et al. . | |
| 5,310,061 | 5/1994 | Kanbar | 206/555 |
| 5,470,138 | 11/1995 | Kump . | |
| 5,687,875 | 11/1997 | Watts et al. | 221/45 |

FOREIGN PATENT DOCUMENTS

| | | | |
|---|---|---|---|
| 451891 | 10/1948 | Canada | 221/35 |
| 238707 | of 1925 | United Kingdom | 206/39 |

*Primary Examiner*—Karen M. Young
*Assistant Examiner*—Thuy V. Tran
*Attorney, Agent, or Firm*—Fitch, Even, Tabin & Flannery

[57] ABSTRACT

This document discloses a coupon dispenser in the form of an integral, vacuum-molded thermoplastic sheet foldable upon itself to enclose a stack of coupons in a box-like container with opposed side wall openings which allow withdrawal of coupons from both sides of the dispensing container. Integrally molded mounting accommodation is provided at one end. In an alternative form, the coupon receptacle proper is separately inserted by halves, respectively, in each foldable part.

8 Claims, 3 Drawing Sheets

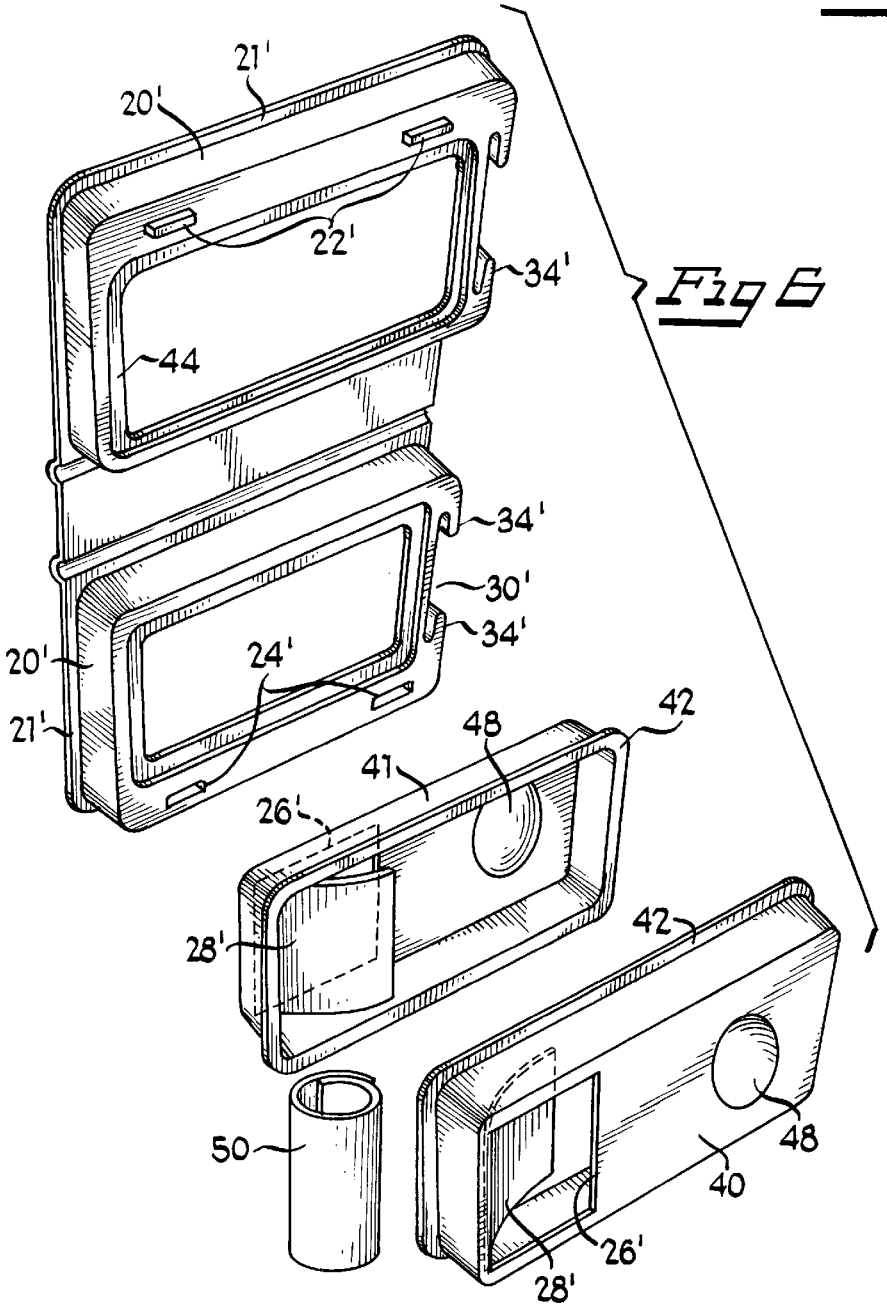
Fig 6
Fig 7
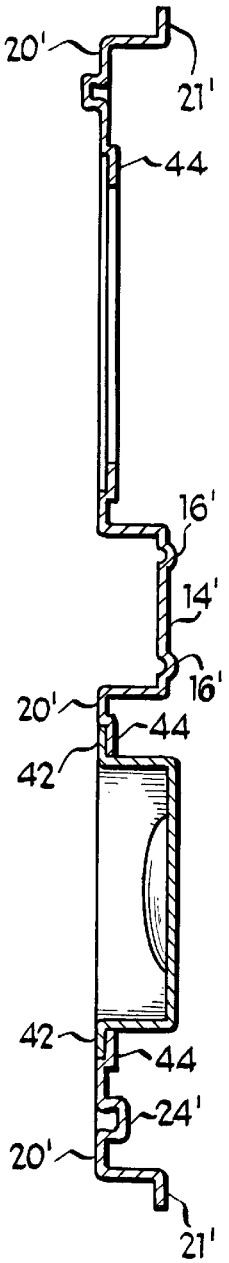
Fig 8
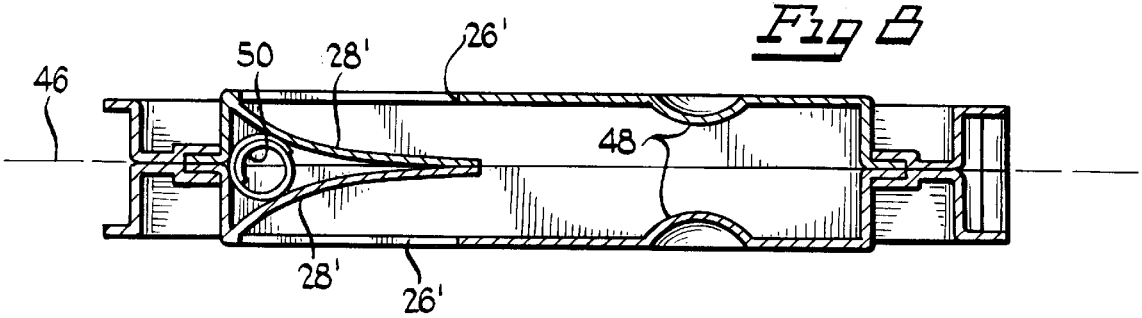

FOLDABLE COUPON DISPENSER

This invention relates to coupon dispensing containers for discount coupons used for merchandising various products to self-serve customers in grocery, mass merchandising, and chain drug stores. In particular, it relates to a simple fold-up dispenser that is vacuum molded of thermoplastic sheet material.

BACKGROUND OF INVENTION

The aim of the invention is to provide a simple, inexpensive coupon dispenser that requires no power source, and is light in weight so as to be mountable equally on the permanent shelving of the store or upon any temporary or knockdown point-of-sale display of goods, such as the eye-catching, stand-alone display racks used to introduce new items, or to feature special offers of items well known.

SUMMARY OF INVENTION

The invention achieves its objective by providing a coupon dispensing container that is vacuum formed of transparent plastic sheet material in two mirror-image halves joined by an integral hinge which allows the two halves to be folded into facing engagement to form a container for a stack of coupons, and at one end thereof, a cavity to receive and retain the mounting lug of a bracket to attach the dispenser to a shelf or to a stand-alone display rack. In one of its forms, the entire dispenser is molded integrally from a single sheet, and in another, the peripheral structural frame of the dispenser is left open to receive and retain two separate coupon receptacles similarly formed of plastic sheet, holding them together in facing relation when the frames are folded upon their hinge connection and secured together. In either case, whether the coupon receptacles are integral with the peripheral frame or separate, each is provided with an appropriated finger opening for access to coupons within.

DESCRIPTION OF DRAWINGS

The invention in both forms is illustrated in the accompanying drawings, to which reference is made in the description to follow. In the drawings.

FIG. 6 is an exploded perspective view of the elements of the second embodiment of the dispenser, whose coupon receptacle portions are formed separately rather than integrally, and inserted into the open frames;

FIG. 7 is a cross-sectional view of the unfolded frames of FIG. 6; and

FIG. 8 is a longitudinal cross-sectional view of the dispenser of FIG. 6 in the assembled condition.

DESCRIPTION OF PREFERRED EMBODIMENTS

As neither of the illustrated embodiments is "preferred" to the exclusion of the other, each being derived from different monetary considerations, the integral, one-piece form will be described first as a matter of convenience.

Referring to FIGS. 1 to 5, inclusive, the dispenser 10 is formed from a single sheet of thermoplastic material of the general kind used to form disposable packaging for fragile fruits such as berries and the like. The material is preferably unpigmented so as to preserve its sparkling transparency to enable the viewer to see and read the face of the coupon within.

Figure 1:
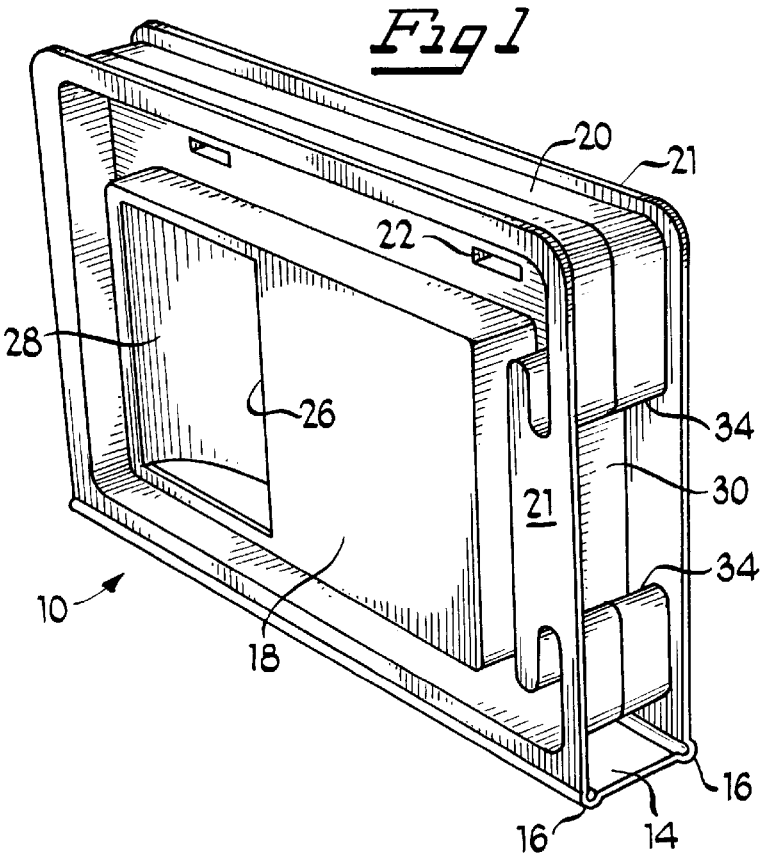
FIG. 1 is a perspective view of the dispenser of the invention in its one-piece, assembled form, viewed from its mounting end.
Figure 2:
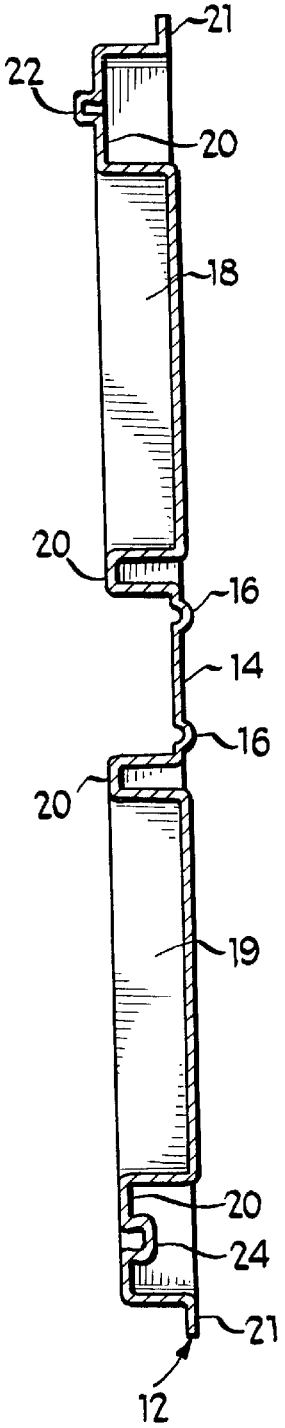
FIG. 2 is a cross-sectional view of the same in its unfolded condition, essentially as it issues from the vacuum mold.
Figure 4:
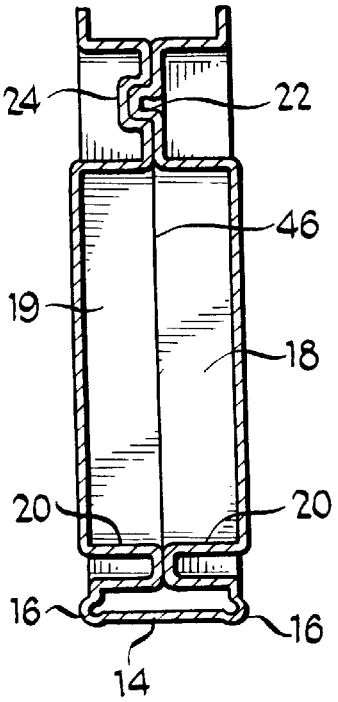
FIG. 4 is a vertical or transverse crosssection of the dispensing container taken on the line 4—4 of FIG. 3, i.e., through one of the integral mortise and tenon snap fasteners which secure the unit in assembled relation.

The single thermoplastic sheet 12 is softened by heat and laid upon a mold which draws it into the three-dimensional configuration illustrated in FIG. 2. As there seen, the formed article comprises a central hinge section 14, defined between half-round beads 16 which determine a pair of bending axes, and two open, rectangular box-like or pan-like coupon receptacles 18 and 19 each defined by an upstanding, rectangular peripheral frame 20 of U-shaped cross-section, constituting half of the coupon container. The outer edge of each frame 20 includes a strengthening peripheral flange 21 which stiffens the frame against wracking. Adjacent the hinge section 14, the U-shaped cross-section of the frame is fairly narrow but wider on the sides of the receptacles 18 distant from the hinge 14. There, the frame 20 of the receptacle 18 is distended outwardly to form a pair of spaced tenons 22 having a slightly headed configuration, while the corresponding frame of the receptacle 19 is distended inwardly to form two mortises 24 to receive the tenons of the first frame in a snap fit to hold the dispenser in the folded or assembled condition of FIGS. 1, 3, 4, and 5.

When so assembled or folded upon each other in facing engagement, the two open receptacles formed by the peripheral frames close upon each other to form a closed box for a stack of coupons (not shown) emplaced within, the floor of each receptacle becoming the side walls of the box, to which the flat side of the coupon stack will face. In that sidewall of each receptacle 18 and 19, a coupon dispensing opening 26 is formed by severing a flap 28 of the material of the side wall, and bending it inwardly in a smooth curve to form a guide to assist the extraction of the closest coupon. When the box is quite full, the guide flap 28 serves to fan the edges of the coupons by bending the stack outwardly, and when less full, it provides a surface against which the user's finger pressure can slide the outermost coupon from the stack. Depending upon the surface character of the coupon material, it may be desirable to dust or otherwise lubricate the coupon sheet material before the coupon stacks are severed from the stacks of multiple coupon sheets in which they are printed, and the persons loading the dispensers will, in any event, want to bend and fan the coupon stacks before loading.

Figure 3:
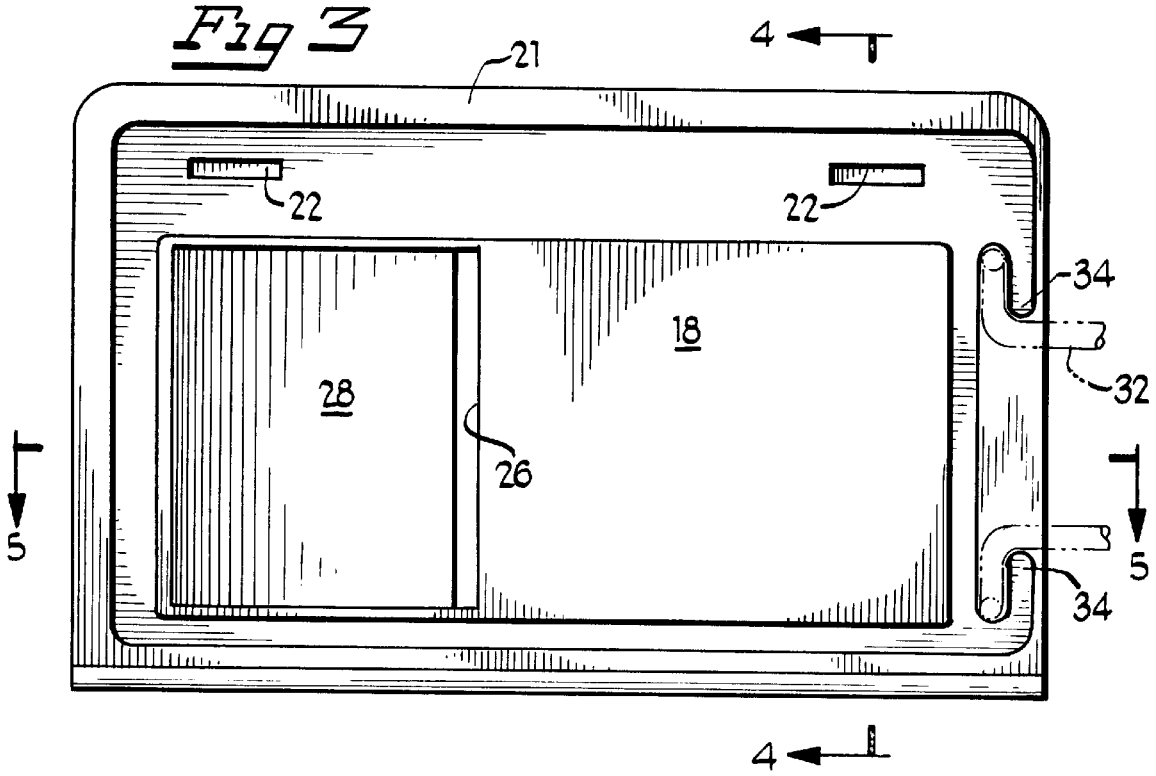
FIG. 3 is a side elevational view of the dispenser of FIGS. 1 and 2, showing how a mounting lug is received and retained in the mounting cavity when the two frames of the unit are folded upon or about it, and also showing the coupon dispensing openings.
Figure 5:
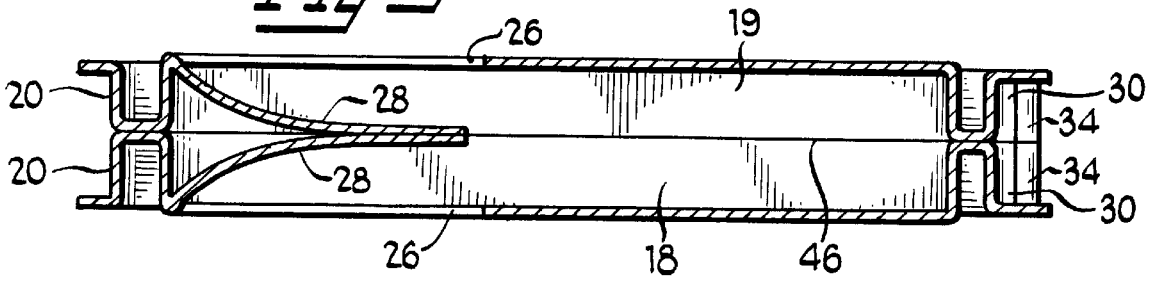
FIG. 5 is a longitudinal cross-section taken on line 5—5 of FIG. 3, i.e., on a mid-plane perpendicular to that of FIG. 4, to show the coupon guides formed from the receptacle material severed and folded inwardly to create the dispensing opening.

At the end of the rectangular dispenser-box opposite the dispensing openings 26, the thermoplastic sheet material of each frame is drawn to provide a mounting well or cavity 30 for receiving the lug of a mounting bracket 32 shown in bent wire form in FIG. 3. Specifically, referring to FIGS. 1 and 3, the outer wall of each U-shaped peripheral frame at the mounting end is formed with two reentrant or S-curves which define a pair of opposed ledges 34 extending inwardly toward each other across a portion of the cavity 30, so that when the two frames are folded into facing engagement, they, together with the deepened edge flange of each frame at that end, form the cavity or well 30 with the two opposed ledges 34 defining the mouth thereof. This arrangement permits the insertion of the mounting lug 32 and the closing of the dispenser frames 20 to capture the enlarged head portion of the mounting lug within the cavity.

The static forces exerted upon the dispenser by the mounting lug, principally the reaction to the weight of its contents, are not directed in such a way as to apply any load tending to open the dispenser, nor to disengage the mortise and tenon fasteners.

The alternate form of the dispenser of the invention shown in FIGS. 6 to 8, inclusive, is in most respects identical to the first form described. That is, it has nearly the same features and configurations of the form of FIGS. 1 to 5, and where they are identical they bear the same reference numerals distinguished by a single prime.

The basic difference characterizing the second form is that the coupon receptacles 40 and 41, rather than being integral with the rectangular border frames 20', are molded separately and each provided with an outwardly-extending, flat rim flange 42. Each peripheral frame, in turn, is open to receive the separate receptacle 40 or 41 as an insertion, and is provided with a stepped, inwardly-extending flange 44 to engage and to seat the outwardly-extending flange of the receptacle. Thus, with receptacles 40 and 41 inserted and with the frames 20' fully folded, the flanges 42 of the receptacles meet in a plane 46 of symmetry, which, as in the case of the first described form, also bisects the hinge section 14' of the molded frame.

The second form also illustrates two additional features whose purpose is to provide pressure on the coupon stack to facilitate the removal of but one coupon at a time. These features are a pair of opposed resilient bubbles or more or less spherical depressions 48 in the side walls of the dispenser toward the mounting end, and a single resiliently expandable curl or coil 50 of plastic sheet material interposed between the opposed flap guides 28' and tending to urge them away from each other and toward the side wall of the dispenser as the supply of coupons within diminishes. This action maintains the coupon supply upright even when diminished, and available to the grasp of a customer seeking to withdraw one.

It will be apparent, of course, that the bubble feature 48 and the separate spring curl or coil 50 may be incorporated and used in the integrally molded form of FIGS. 1 to 5 as well.

The differences between the two forms of the invention here disclosed relate primarily to matters of cost. It will be appreciated that the separately molded multiple parts of FIGS. 6 to 8 represent increased manufacturing cost by requiring additional mold and trim tooling over the form of FIGS. 1 to 5. However, that additional cost is more than offset by anticipated savings of labor cost resulting from greater ease of loading coupons. In each case, however, half of the full load of coupons is loaded into each receptacle, with the two guide flaps 28 or 28' acting as a stack divider, as will be appreciated from each of FIGS. 5 and 8.

It will be seen from the foregoing description that the invention provides a relatively inexpensive coupon dispenser which does not require either power or maintenance for its operation, and can be readily replaced owing to its small cost. It can be manufactured in bulk quantity and shipped in knocked down or flat condition with the coupon stacks in relatively little space, and assembled and loaded, if desired, at the point of sale of the product or products to which the coupon is germane.

The features of the invention believed new and patentable are set forth in the following claims.

What is claimed is:

1. A plastic coupon-dispenser of thermoplastic sheet material drawn to form a central hinge section and mating rectangular peripheral frames having surrounding border flanges integral with said hinge section along one side of said frames, said frames being foldable about said hinge section to meet on a plane intersecting said hinge section, said frames being drawn to form at one end of the frames when folded an endwardly facing cavity with opposed overlying ledges to receive and retain a separately insertable mounting lug, and fastening means for holding said frames engaged on said plane;

each said frame having associated therewith a rectangular pan-like receptacle formed of thermoplastic sheet material for holding a stack of coupons and having an opening therein through which to withdraw a coupon from the stack, said receptacles forming an enclosing box for said coupons when said frames are engaged on said plane.

2. The dispenser of claim 1 wherein said receptacles are molded integrally with said frames and hinge section.

3. The dispenser of claim 1 wherein said receptacles are separate from said frames and formed with integral outwardly-extending rim flanges held in mutual engagement on said plane of symmetry by inwardly extending flanges on said peripheral frames.

4. The dispenser of claims 1, 2, or 3 wherein said opening in said rectangular receptacle is made in the surface thereof faced by the flat side of the coupon stack within, and is made at the end of the receptacle opposite the mounting end of the dispenser, each said opening being formed by severing from said surface an inwardly-directed flap of the receptacle material to serve as a guide for withdrawal of the coupons.

5. The dispenser of claim 4 wherein the inwardly directed flaps associated with said openings are resiliently biased away from each other.

6. A plastic coupon dispenser drawn from a single sheet of thermoplastic material to form a pair of mating, flanged, rectangular receptacles integrally connected along a corresponding flange of each and foldable into facing relation along said corresponding flanges to form a surrounding container for a stack of coupons, fastening means to hold said receptacles in facing relation, and mounting means for presenting the dispenser for use, said receptacles each having an opening opposed to the opening in the other to permit the withdrawal of a coupon through either.

7. The dispenser of claim 6 wherein each opening is formed in the surface of said receptacle faced by the flat of said coupons, and is formed by severing from said surface an inwardly directed flap of the receptacle material to serve as a guide for the withdrawal of the coupons.

8. The dispenser of claim 7 wherein the flaps of said opposed openings are resiliently biased away from each other.

* * * * *